US008512161B2

(12) United States Patent
Dalbke

(10) Patent No.: US 8,512,161 B2
(45) Date of Patent: Aug. 20, 2013

(54) GOLF GLOVE TRAINING DEVICE

(71) Applicant: Brian Dalbke, Elk Grove Village, IL (US)

(72) Inventor: Brian Dalbke, Elk Grove Village, IL (US)

( * ) Notice: Subject to any disclaimer, the term of this patent is extended or adjusted under 35 U.S.C. 154(b) by 0 days.

(21) Appl. No.: 13/650,216

(22) Filed: Oct. 12, 2012

(65) Prior Publication Data

US 2013/0184092 A1 Jul. 18, 2013

Related U.S. Application Data

(60) Provisional application No. 61/587,343, filed on Jan. 17, 2012.

(51) Int. Cl.
*A63B 69/36* (2006.01)
*A41D 19/00* (2006.01)

(52) U.S. Cl.
USPC ..... 473/205; 473/213; 2/161.2

(58) Field of Classification Search
USPC ..... 473/205, 212, 213, 214, 458; 2/160, 2/161.2, 161.4, 159, 162
See application file for complete search history.

(56) References Cited

U.S. PATENT DOCUMENTS

| | | | | |
|---|---|---|---|---|
| 2,064,603 | A * | 12/1936 | Harrison | 434/252 |
| 3,865,383 | A | 2/1975 | Clay et al. | |
| 4,222,569 | A * | 9/1980 | DeMascolo | 473/213 |
| 5,158,298 | A | 10/1992 | Goins | |
| 5,180,169 | A * | 1/1993 | Choy | 473/213 |
| 5,207,430 | A | 5/1993 | Goins | |
| 5,435,007 | A | 7/1995 | Kalvestran et al. | |
| 5,492,331 | A | 2/1996 | Kawakami | |
| 5,509,809 | A | 4/1996 | Clay | |
| 5,797,803 | A | 8/1998 | Jung | |
| 5,823,886 | A * | 10/1998 | Murray | 473/213 |
| 5,827,126 | A * | 10/1998 | Lee | 473/213 |
| 5,876,292 | A | 3/1999 | Hamilton | |
| 7,220,188 | B2 * | 5/2007 | Lee | 473/205 |
| 2006/0281573 | A1 | 12/2006 | Lee | |

* cited by examiner

*Primary Examiner* — Nini Legesse
(74) *Attorney, Agent, or Firm* — Buckingham, Doolittle & Burroughs, LLP

(57) ABSTRACT

A golf glove training device comprised of a plurality of corresponding block portions that engage/disengage during a golfer's swing for aiding a golfer to develop muscle memory for keeping his or her wrist hinged during a golf swing. The golf glove training device of the present invention also provides audible cues to the golfer with respect to whether proper form has been achieved and maintained during the golf swing.

6 Claims, 4 Drawing Sheets

GOLF GLOVE TRAINING DEVICE

CROSS-REFERENCE

This application claims priority from Provisional Patent Application Ser. No. 61/587,343 filed on Jan. 17, 2012.

FIELD OF THE INVENTION

This invention relates to a golf glove device for training a golfer to keep his or her wrist hinged during a golf swing.

BACKGROUND

Millions of men, women and children in the United States, and many more worldwide, enjoy golfing as a sport and as a pastime, and are always looking for new and novel ways of improving their golf game. For example, many right handed golfers have a tendency to cast their wrist during their golf swing before their golf club makes contact with the golf ball, thereby causing the golf ball to oscillate from left to right and ultimately land short of its intended target. Similar problems exist for left handed golfers. Other golfers tend to hit the golf ball "fat", which is where the golf club head hits the ground just before striking the golf ball, due to poor hand/wrist form during their golf swing. Still others, without proper hand/wrist form during their golf swing, are incapable of making a "stinger" golf shot, which is where the golf ball hits the putting green and stops almost immediately. Still other golfers require training and muscle memory with respect to many chip shots and pitch shots, which require a hinge and hold type of wrist action. The inability to overcome such difficulties tends to discourage golfers from further participating in and/or enjoying the sport of golf.

In an effort to overcome the above described difficulties, many golfers continuously practice their golf swings to improve their muscle memory and train themselves to maintain proper hand/wrist form during their swing. Nonetheless, without a proper training tool, many golfers are unsure as to whether or not they are achieving and maintaining proper hand/wrist form during their golf swings. Still others engage a golf instructor or golf professional in an effort to improve their golf swing, but such lessons are expensive and may be cost prohibitive for many golfers. Attending golf lessons can also be time consuming and inconvenient.

Consequently, there exists in the art a long-felt need for a golf glove training device that will assist a golfer in developing the muscle memory necessary for keeping the golfer's wrist hinged during his or her golf swing. There also exists in the art a long felt need for a golf glove training device that provides some audible and/or visual feedback as to when the proper hand/wrist form has been achieved and maintained. Additionally, there is a long felt need in the art for a training device that can be used by experienced golfers (i.e., with a low handicap) to train the golfer to achieve the amount of fade or draw that the golfer desires by the positioning of the wrist during the golf swing. Finally, there is a long-felt need for a golf training device that accomplishes all of the forgoing objectives and that is relatively inexpensive to manufacture, and safe and easy to use.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, is a golf glove training device comprised of a golf glove, a first block portion and a second block portion. The golf glove is further comprised of an opening for receipt of a wearer's hand and an exterior surface, wherein said exterior surface is comprised of a backhand portion and a sleeve portion. The first block portion is attached to the exterior surface of the backhand portion of the glove, and the second block portion is attached to the exterior surface of the sleeve portion, which extends partially up the forearm of the wearer.

The first block portion is preferably generally rectangular in shape from a top view and comprised of a front surface, side surfaces, a back surface and a top surface. First block portion extends outwardly from the backhand portion of the exterior surface of the golf glove. The top surface of first block portion may further comprise a plurality of fasteners, such as hook and loop fasteners, and is preferably sloped downwardly in the direction of the second block portion and the wearer's forearm.

The second block portion is also preferably generally rectangular in shape from a top view and is comprised of a front face or faces, side faces and a top. Second block portion extends outwardly from the sleeve portion of the exterior surface of the golf glove. The front face or faces of the second block portion are in the general direction of the first block portion and may further comprise a plurality of fasteners, such as hook and loop fasteners thereon. The front face or faces are also preferably angled inwardly (i.e., in the direction of opening 20) from the top face of second block portion for achieving mating contact with the top surface of first block portion when the wearer's wrist is properly hinged during a golf swing and the device is in a closed position.

The golf glove training device of the present invention also provides the wearer with a cue as to whether or not the golfer has achieved and maintained proper wrist form during his or her golf swing. More specifically, in one particular embodiment of the present invention, as the wearer's wrist is hinged into proper form, the Velcro® fasteners on the top surface of the first block engage with the Velcro® fasteners on the front face(s) of the second block, thereby indicating to the wearer that his or her wrist is properly positioned for the swing, and helping to maintain said positioning of the wrist. The detaching of said Velcro® surfaces as the ball is struck should provide the wearer with an audible cue that the swing has been completed correctly. Likewise, the premature detachment of the Velcro® surfaces (i.e., prior to the ball being struck with the head of the golf club) will also provide an audible cue to the wearer that proper wrist form was not properly maintained during the swing, and that additional practice and/or muscle memory training is required.

Consequently, the golf glove training device of the present invention enables a golfer to develop muscle memory and to keep his or her wrist hinged during a golf swing. Additionally, the golf glove training device of the present invention is relatively inexpensive to manufacture, and safe and easy to use.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DETAILED DESCRIPTION

Figure 1A:
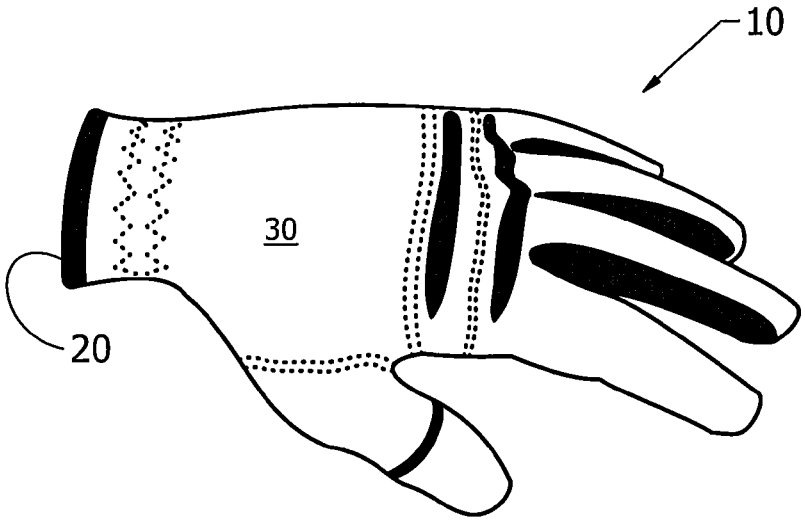
(PRIOR ART) FIG. 1A
FIG. 1A illustrates a perspective view of a prior art golf glove.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details.

The golf glove training device of the present invention enables a golfer to develop muscle memory and to keep his or her wrist properly hinged during a golf swing. The training device of the present invention also provides the golfer with a cue as to whether the golfer is in proper form to complete his or her golf swing. Finally, the golf glove training device of the present invention is relatively inexpensive to manufacture, and safe and easy to use.

By way of background and referring initially to the drawings, FIG. 1 illustrates a perspective view of a prior art golf glove 10 of the type commonly worn by golfers to improve their grip on their golf club and improve the golfer's golf game. Prior art golf glove 10 is well known in the art and typically comprises an opening 20 for receipt of a wearer's hand and a relatively uninhibited exterior surface 30 that generally conforms to the contours of a user's hand when worn. Prior art golf gloves 10 are currently manufactured to accommodate right or left handed golfers and come in a number of different sizes, colors, and materials to suit user preference. Prior art golf gloves may have full finger enclosures, as shown in FIG. 1A, or may have partial finger enclosures (not shown) wherein the end of the wearer's fingers are exposed.

It is not uncommon for prior art golf gloves 10 to further comprise a non-slip or gripping surface (not shown) on those portions of exterior surface 30 that frequently come into contact with the handle of a golf club (not shown in FIG. 1) to improve the wearer's grip on the club. Each of the forgoing features of prior art golf glove 10 are well known in the art in various embodiments and should not be construed as a limitation. However, as previously stated, existing golf gloves do not provide the wearer with any additional benefit, such as improving the wearer's muscle memory and/or swing, nor do they provide the wearer with a cue that indicates whether the wearer has achieved and maintained proper wrist/hand form during their swing. An effective solution is necessary.

Figure 1B:
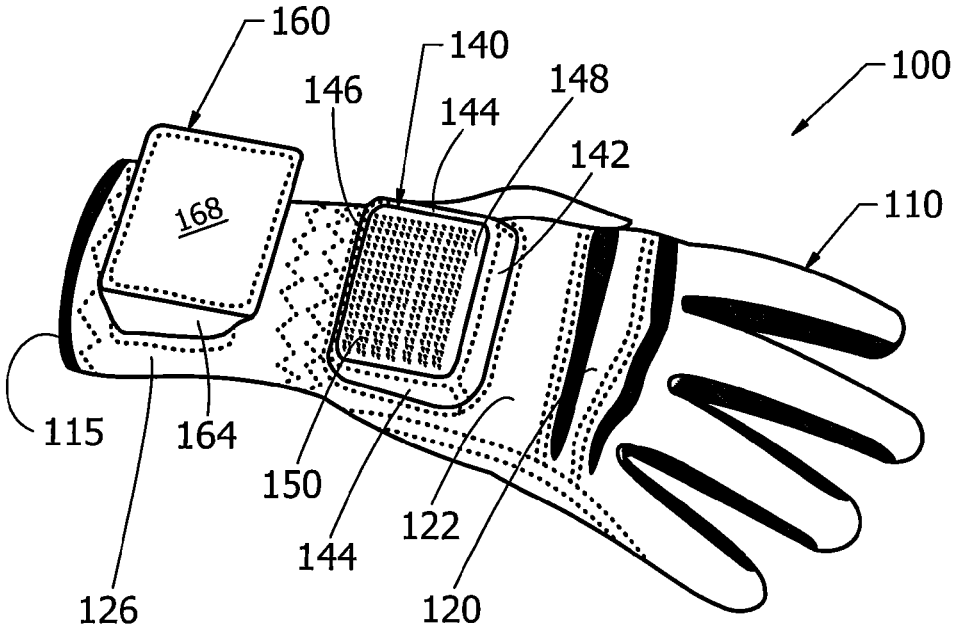
FIG. 1B illustrates a perspective view of the golf glove training device of the present invention in an open position.

FIG. 1B illustrates a perspective view of one embodiment of the golf glove training device 100 of the present invention, which comprises a golf glove 110, a first block portion 140 and a second block portion 160. Golf glove 110 further comprises an opening 115 for receipt of a wearer's hand (not shown) and an exterior surface 120. Golf glove 110 can be manufactured from any suitable material known in the art such as leather, a microfiber, nylon, polyester, etc., and can also be manufactured to accommodate right handed or left handed golfers. Golf glove 110 can also be manufactured in a variety of sizes, colors, styles and designs to accommodate user preference, and may further comprise full finger enclosures, as shown in FIG. 1A, or may have partial finger enclosures (not shown) wherein the end of the wearer's fingers are exposed.

Figure 2A:
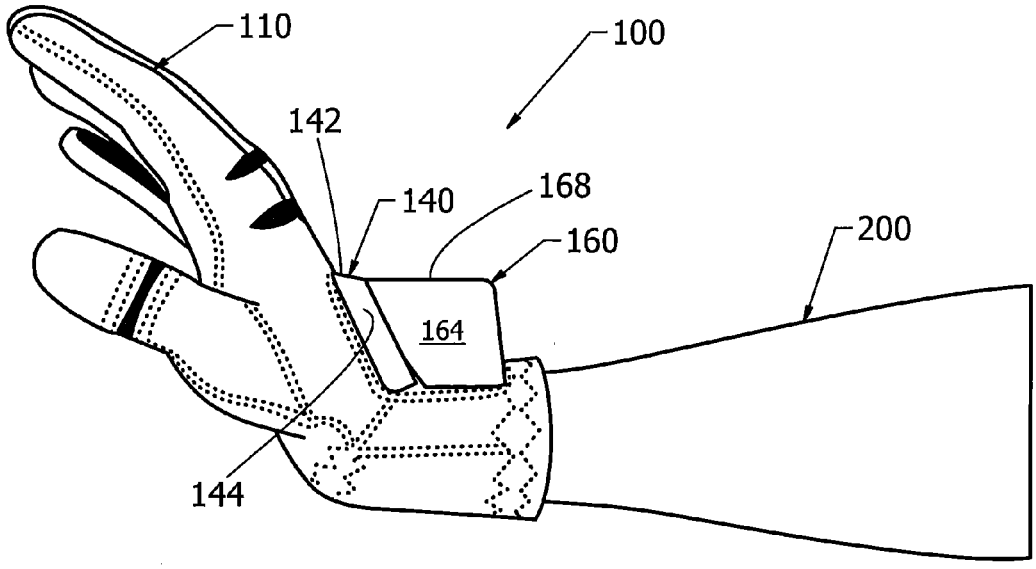
FIG. 2A illustrates a side elevational view of the golf glove training device of the present invention in a closed position and installed on a golfer's hand, wherein the top surface of the first block portion is in removable contact with a portion of the front face of the second block portion.

Exterior surface 120 is further comprised of a backhand portion 122 and a sleeve portion 126, as illustrated in FIG. 1B. Backhand portion 122 refers to the portion of exterior surface 120 that generally covers the backhand of the wearer. Sleeve portion 126 refers generally to the portion of exterior surface 120 that extends from the backhand portion 122 to the opening 20, which extends partially up the forearm of the wearer as shown in FIG. 2A. In a preferred embodiment of the present invention, sleeve portion 126 extends between two and four inches up the wearer's forearm as measured from the wearer's wrist joint (not shown), though it is contemplated that other lengths could also be used without impacting the overall concept of the present invention.

Figure 2B:
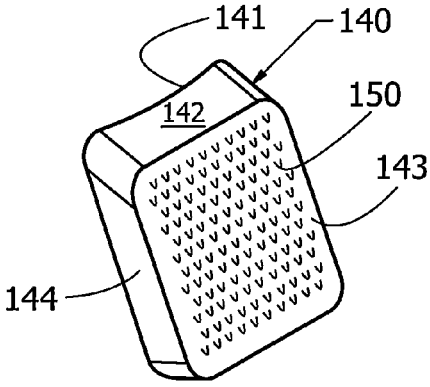
FIG. 2B illustrates a prospective stand alone view of the first block portion.

As illustrated in FIG. 2B, first block portion 140 is preferably generally rectangular in shape from a top view and is comprised of a base 141, a front surface 142 which faces in the direction of the wearer's fingers, opposing side surfaces 144, a back surface 146 which faces generally in the direction of second block portion 160, and a top surface 148. First block portion 140 is preferably constructed of plastic, though any other suitable materials such as wood or metal could also be used without affecting the overall scope of the invention. As illustrated in FIG. 2A, first block portion 140 extends outwardly from the backhand portion 122 of the exterior surface 120 of golf glove 110, and may be integrally formed with golf glove 110 or subsequently attached to the backhand portion 122 by any means commonly known in the art such as with an adhesive, glue or other binding agent. First block portion 140 may also be stitched into or encased or partially covered by exterior surface 120. First block portion 140 may have a hollow interior to reduce the weight of first block portion.

In a preferred embodiment of the present invention, first block portion 140 extends outwardly from the backhand portion 122 between ¼ and ½ of an inch along the front surface 142 and between 1/16 and 3/16 of an inch along the back surface 146, thereby causing top surface 148 to slope gently downward in the direction of the wearer's wrist. The slope of top surface 148 is preferably between 155 and 175 degrees, as measured in the counterclockwise direction from the base 141 of first block portion 140. In a preferred embodiment of the present invention, first block portion is between 1¾ and 2¼ inches in width, as measured from one side surface 144 to the opposing side surface 144, and between one and 1½ inches in length, as measured from the front surface 142 to the back surface 146. Nonetheless, it is contemplated that other dimensions could also be used to accommodate the particular size and/or shape of the wearer's hand without affecting the overall concept of the present invention.

In a preferred embodiment of the present invention, top surface 148 of first block portion 140 further comprises a plurality of fasteners, such as hook and loop or Velcro® fasteners 150, as best shown in FIG. 2B, for attachment and detachment to similar fasteners 150 which are located along second block portion 160. Fasteners may be attached to said first block portion 140 and second block portion 160 by any means commonly known in the art such as with glue, adhesive or stitching. The purpose and usefulness of fasteners 150 are described more fully below.

Figure 2C:
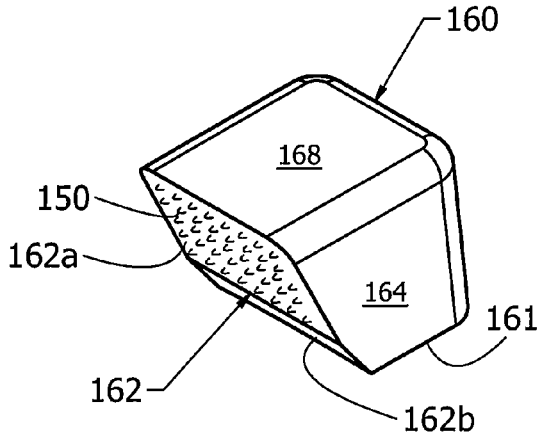
FIG. 2C illustrates a prospective stand alone view of the second block portion.

As best illustrated in FIG. 2C, second block portion 160 is also preferably generally rectangular in shape from a top view and comprised of a bottom 161, a front face 162 which faces in the direction of first block portion 140, opposing side faces 164, a back face 166 which faces in the general direction of the wearer's upper arm, and a top 168. Similar to first block portion 140, second block portion 160 is preferably constructed of plastic, though any other suitable materials such as wood or metal could also be used without affecting the overall scope of the invention. Second block portion 160 may also have a hollow interior to reduce the weight of second block portion. Second block portion 160 extends outwardly from the sleeve portion 126 of the exterior surface 120 of golf glove 110, and may be integrally formed with golf glove 110 or subsequently attached to the sleeve portion 126 by any means commonly known in the art such as with an adhesive, glue or other binding agent. Second block portion 160 may also be stitched into or encased or partially covered by exterior surface 120.

In a preferred embodiment of the present invention, second block portion 160 is spaced between 1¼ and 1½ inches away from first block portion 140 at its closest point, though other distances are also contemplated to accommodate particular users.

Figure 3A:
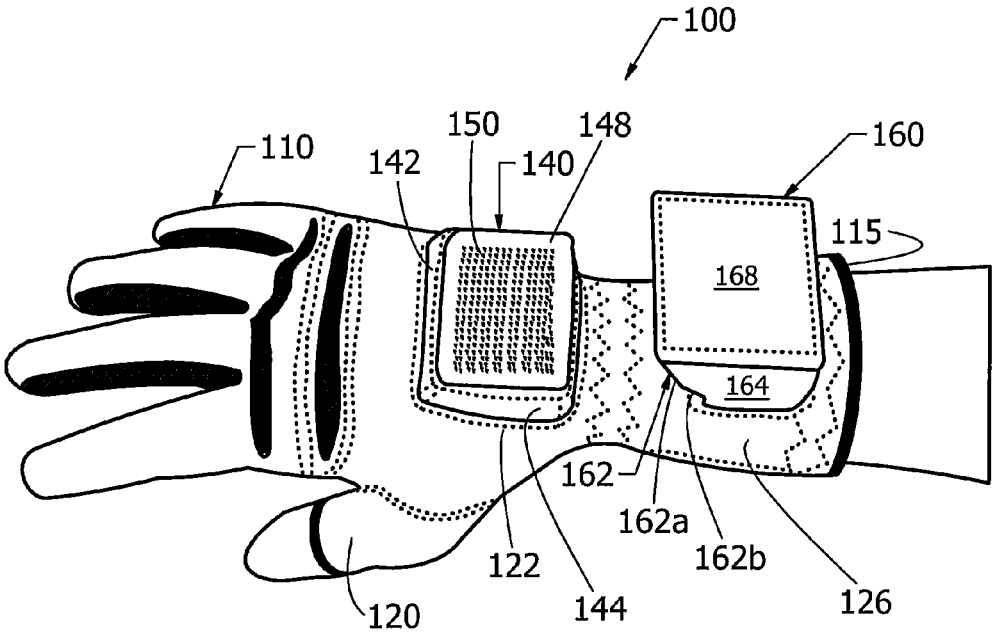
FIG. 3A illustrates a perspective view of the golf glove training device in an open position installed on a golfer's hand.

In a preferred embodiment of the present invention, second block portion 160 extends outwardly from sleeve portion 126 by between 1¾ and 2¼ inches, and is between 1¾ and 2¼ inches in width, as measured from one side face 164 to the opposing side face 164. While back face 166 is generally perpendicular to both the sleeve portion 126 and top 168, front face 162 is generally angled inwardly from top 168 in the direction of bottom 161, as best shown in FIGS. 2C and 3A. Additionally, front face 162 may be further comprised of an upper front face surface 162*a* and a lower front face surface 162*b*, each with differing angles of incline from bottom 161 to top surface 168. More specifically, lower front face 168*b* preferably extends outwardly and upwardly from bottom 161 in the general direction of top 168 at an angle of between 130 and 140 degrees as measured in the counterclockwise direction from the bottom 161. The upper front face 162*a* is connected to the lower front face 162*b* and intersects top surface 168 at an angle that is between 290 and 310 degrees as measured in the counterclockwise direction from top surface 168. Based on the above referenced dimensions and angles, the overall length of the top 168 of second block portion 160 should be between 2⅝ and 2⅞ inches, and the total distance between lower front face 162*b* and back face 166 nearest exterior surface 120 is between 1⅛ and 1⅜ inches. Nonetheless, it is contemplated that other dimensions could also be used to accommodate the particular size and/or shape of the wearer's hand.

In a preferred embodiment of the present invention and similar to the top surface 148 of first block portion 140, front face 162 further comprises a plurality of fasteners, such as hook and loop or Velcro® fasteners 150, as best shown in FIG. 2C, for attachment and detachment to the fasteners 150 which are located along the top surface 148 of first block portion 140. The purpose and usefulness of fasteners 150 are described more fully below.

Having now described the preferred embodiment of golf glove training device 100, its use and usefulness will now be described. The golf glove training device 100 of the present invention guides a golfer in performing a proper golf swing, which involves, for example, a right handed golfer bringing a golf club straight back so that the golfer's wrist hinges upward, the face of the golf club faces downward in the direction of the ground, and the golfer's hips are turned back. As the golf club shaft reaches over the golfer's right shoulder, the golfer's right shoulder turns and keeps the golf club on plane, pointing down the target line with the golfer's wrist still hinged. On the down swing, the bottom of the club shaft should point towards the ball. As the golfer's hips turn forward, the golf club shaft should be relatively parallel to the ground and the grip of the golf club should be past the golf ball, keeping the wrist hinge in place until the golf club head makes contact with the ball.

Figure 3B:
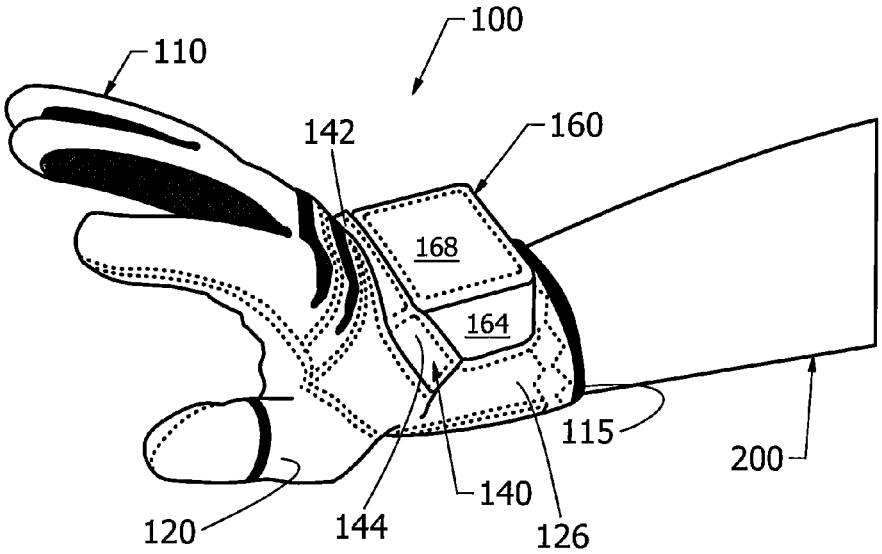
FIG. 3B illustrates a perspective view of the golf glove training device in a closed position installed on a golfer's hand.
Figure 4:
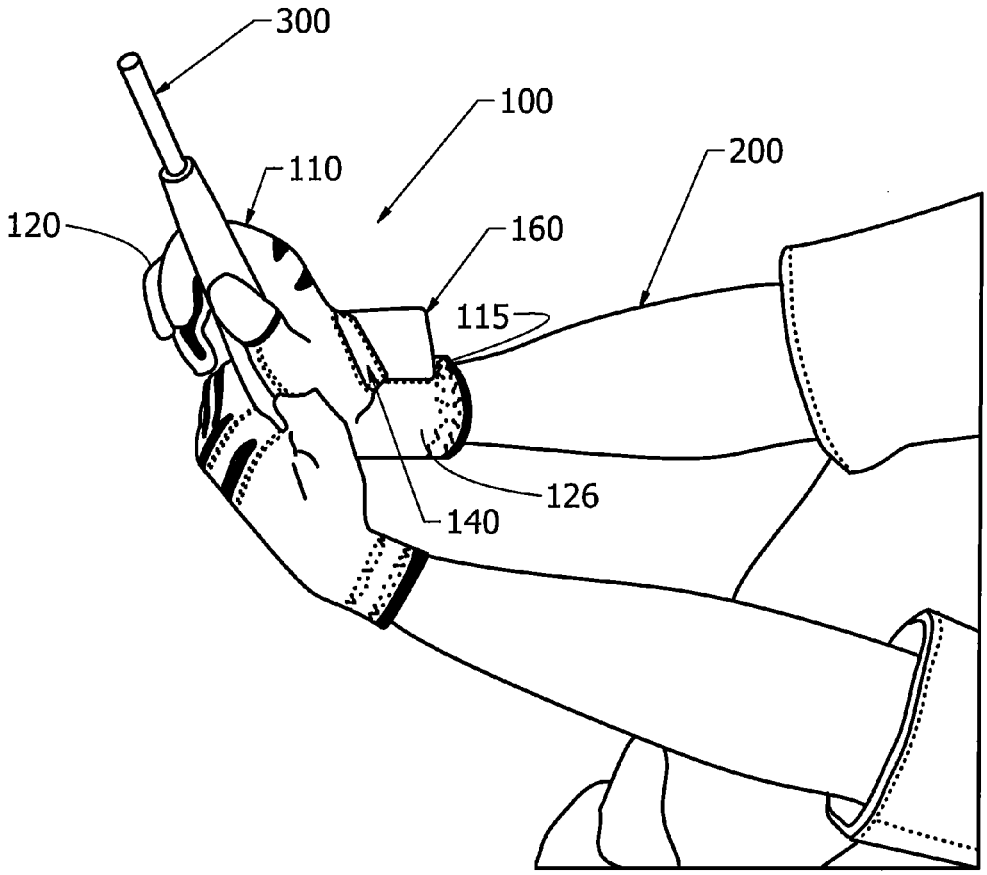
FIG. 4 illustrates a perspective view of the golf glove training device in the closed position and being worn on the hand of a golfer.

A golfer 200 desiring to utilize the golf glove training device 100 of the present invention to increase muscle memory and improve his or her swing, will insert his or her dominant hand into opening 115 of glove 110 such that backhand portion 122 is generally over the backhand of the golfer's hand and so that sleeve portion 126 is generally over the lower forearm of the golfer 200 and the training device is in an open position (best illustrated in FIG. 3A). As best shown in FIG. 4, as the golfer flexes his or her wrist in anticipation of completing a swing of a golf club 300, the golf glove training device 100 moves into a closed position (best illustrated in FIG. 3B), which means that the fasteners 150 located on the surface 148 of first block portion 140 are in removable contact with the fasteners 150 attached to the front face 162 of second block portion 160. As the golf glove training device 100 of the present invention is moved into a closed position, the coming together of the Velcro® fasteners 150 on the top surface 148 of first block portion 140 with the Velcro® fasteners 150 on the front face 162 of second block portion 160 provides the golfer 200 with an audible cue that proper hand/wrist form has been achieved and that the golfer 200 can proceed with the golf swing. During a proper swing of golf club 300, the golf glove training device of the present invention will remain in the substantially closed position until the club head strikes the golf ball.

As the golf club head (not shown) strikes the golf ball (also not shown), the wrist should unhinge and the separation of the Velcro® fasteners 150 on the top surface 148 of first block portion 140 from the Velcro® fasteners 150 on the front face 162 of second block portion 160 in that instant provides an audible cue to the golfer 200 that proper wrist form was maintained during the golf swing. Similarly, the premature separation (i.e., before the golf club head contacts the ball) of the Velcro® fasteners 150 on the top surface 148 of first block portion 140 from the Velcro® fasteners 150 on the front face 162 of second block portion provides an audible cue to the golfer 200 that proper wrist form was not maintained during the golf swing and that additional practice is necessary. It is recommended that the golf glove training device of the present invention only be used in connection with practice sessions, as it may be a violation of a golf rule to record a round of golf score while having used a training aid, though it is contemplated that the device could also be used in a competitive round of golf.

Consequently, the golf glove training device of the present invention enables a golfer to not only practice his or her golf swing, but to also keep his or her wrist hinged during a golf swing. Additionally, the golf glove training device of the present invention provides cues to the golfer as to whether proper hand/wrist form has been achieved and/or maintained during the golf swing. Repeated use of the golf glove training device will help the golfer develop muscle memory, which will eventually allow the golfer to perform a perfect golf swing with or without the golf glove training device. Anyone interested in improving their golf swing would benefit from this convenient and effective tool. Finally, the golf glove training device of the present invention is relatively inexpensive to manufacture, and safe and easy to use.

Additionally, other variations are within the spirit of the present invention. Thus, while the invention is susceptible to various modifications and alternative constructions, a certain illustrated embodiment thereof is shown in the drawings and has been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein. Variations of those preferred embodiments may become apparent to those of ordinary skill in the art upon reading the foregoing description. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A golf glove training device comprising:

a golf glove;

a first block portion, wherein said first block portion further comprises a top surface with at least one hook and loop fastener thereon; and a second block portion, wherein said second block portion further comprises a front face with at least one hook and loop fastener thereon.

2. The golf glove training device of claim 1 wherein the top surface is angled downwardly in the general direction of the second block portion, and wherein the second block portion further comprises a top, wherein the front face of said second block portion is angled inwardly from the top.

3. A golf glove training device comprising:

a golf glove;

a first block portion with at least one hook and loop fastener attached thereto; and a second block portion with at least one hook and loop fastener attached thereto, wherein said first block portion and second block portion function to alert a golfer as to whether the golfer is positioned properly to complete a golf swing.

4. The golf glove training device of claim 3, wherein said first block portion comprises a top surface and said second block portion comprises a front face for contacting said top surface when the golf glove training device is in a closed position.

5. A golf glove training device comprising:

a golf glove;

a first block portion, wherein said first block portion is comprised of a base, a front surface, a pair of side surfaces, a back surface and a top surface; and a second block portion, wherein said second block portion is comprised of a bottom, a front face, a pair of sides faces, a back face and a top and wherein said top surface is sloped at an angle of between 155 and 175 degrees as measured in the counterclockwise direction from the base of first block portion, and wherein said front face is further comprised of an upper front face an a lower front face.

6. The golf glove training device of claim 5, wherein said upper front face extends from the top surface at an angle that is between 290 and 310 degrees as measured in the counterclockwise direction from said top surface, and said lower front face extends from said bottom at an angle of between 130 and 140 degrees as measured in the counterclockwise direction from the bottom.

* * * * *